United States Patent [19]

Bengtsson

[11] 4,313,494

[45] Feb. 2, 1982

[54] PLATE HEAT EXCHANGER

[75] Inventor: Folke Bengtsson, Stockholm, Sweden

[73] Assignee: Carl Johan Lockmans Ingenjorsbyra, Stockholm, Sweden

[21] Appl. No.: 189,928

[22] PCT Filed: May 22, 1979

[86] PCT No.: PCT/SE79/00115

§ 371 Date: Jan. 22, 1980

§ 102(e) Date: Dec. 27, 1979

[87] PCT Pub. No.: WO79/01098

PCT Pub. Date: Dec. 13, 1979

[30] Foreign Application Priority Data

May 22, 1978 [SE] Sweden ..... 7805829

[51] Int. Cl.[3] ..... F28F 3/12

[52] U.S. Cl. ..... 165/148; 165/166

[58] Field of Search ..... 165/166, 167, 170, 148

[56] References Cited

U.S. PATENT DOCUMENTS

| | | | |
|---|---|---|---|
| 2,940,736 | 6/1960 | Ödman | 165/166 |
| 3,249,155 | 5/1966 | Huet | 165/166 |
| 3,451,473 | 6/1969 | Urie et al. | 165/166 |
| 3,931,854 | 1/1976 | Ivakhnenko et al. | 165/166 |
| 4,099,928 | 7/1978 | Norback | 165/166 X |
| 4,182,410 | 1/1980 | Yoshida et al. | 165/166 X |
| 4,182,411 | 1/1980 | Sumitomo et al. | 165/167 X |
| 4,228,850 | 10/1980 | Sumitomo | 165/166 X |
| 4,230,179 | 10/1980 | Uehara et al. | 165/167 X |

FOREIGN PATENT DOCUMENTS

| | | | |
|---|---|---|---|
| 509867 | 2/1955 | Canada | 165/167 |
| 1379159 | 10/1964 | France | 165/166 |
| 7404486-8 | 10/1974 | Sweden | 165/166 |
| 1183183 | 3/1970 | United Kingdom | 165/167 |

*Primary Examiner*—Sheldon J. Richter

*Attorney, Agent, or Firm*—Holman & Stern

[57] ABSTRACT

The invention relates to a plate heat exchanger, which comprises a plurality of plates located to the side of each other and consisting each of two sheets facing toward each other, which sheets are formed with longitudinal valleys, which facing toward each other form passages between the sheets when the sheets abut each other. The object of the invention is to provide a plate heat exchanger with straight unobstructed passages in order to reduce the problem of clogging and to facilitate cleaning. Between adjacent passages there must be free flow so that washing can be carried out even when a single passage should have been clogged. A further advantage is that the sheets can be formed in press tools without risk of fracture indications to arise. The invention implies that the valleys (5) are formed with grooves (19) transverse to the longitudinal direction of the valley and extending continuously from one outermost located valley to the other outermost located valley.

10 Claims, 14 Drawing Figures

PLATE HEAT EXCHANGER

BRIEF SUMMARY OF THE INVENTION

This invention relates to an arrangement at a plate heat exchanger comprising a plurality of plates, which are arranged to the side of each other and consist each of two plates facing toward each other and formed with longitudinal valleys, which facing toward each other form passages between the plates when the plates abut one another. The object of the present invention is to produce a plate heat exchanger, the plates of which are made of thin sheet metal of 0.75–1.5, mm and can operate at unidirectional pressure of up to 25 bar at a temperature of 150° C. It shall be possible to joint the sheets with a minimum of welding and in such a manner, that repairs can be carried out without having to substantially dismantle the apparatus. A further object is to design the end boxes or end connecting pieces so, that the welded joint withstands operating pressures without arrangement of extra reinforcements or tie-rods. The resulting plate heat exchanger shall be compact and include straight unobstructed passages, in order to reduce the problem of clogging and to facilitate cleaning. There shall be free flow between adjacent passages so that washing can be carried out even when a single passage has been clogged. It is also endeavored to design the passages so as to yield a good flow pattern with respect to pressure drop and heat transfer. A further object of the invention is to achieve a structure, which permits forming of the plates in press tools without risk that indications of fracture may occur.

For achieving the aforesaid objects, the invention has been given the characterizing features, which are defined in the attached claims and which substantially imply, that the valleys are formed with grooves, which extend perpendicularly to the longitudinal direction of the valley continuously from one outermost located valley to the other outermost located valley.

The arrangement of the transverse grooves implies, in addition to the aforesaid advantages and objects, that no spring-back occurs after the pressing of the plates. The pressing, therefore, can be carried out without edge holding, and no trimming of the edges after pressing is required. The operations, thus, are fewer, and the material consumption is smaller. Owing to the arrangement of the grooves, furthermore, the plates are provided with support points, so that between the support points free openings are formed, through which flow between two adjacent passages can take place.

A further problem involved with plate heat exchangers of thin sheet metal is to establish the connection between the plates and the distribution connecting piece and collection connecting piece at each end. A special embodiment of the invention solves this problem so, that good welded joints without weakening edge displacements are obtained.

The plate package can be held together in a way known per se, but a special embodiment therefor is comprised in the invention idea.

The invention implies improvement from a flow aspect, and in this respect the grooves in the plates have a favourable impact both on the medium flowing within the passages of the plates and on the medium flowing outside and about the plates. The intersecting and inclined grooves and ridges yield repeated cross-sectional changes. The flow rate for the media thereby is constantly varied, and the grooves and ridges give impulses to directional changes of the flowing media, which contributes to a good heat transfer.

As already mentioned, the invention facilitates the cleaning of the passages. At a plate heat exchanger with closed passage sides the exchanger must be opened for a mechanic cleaning of completely clogged passages. The present invention renders possible a chemical cleaning in situ of the plate heat exchanger without dismantling and disassembling, because there are openings between the passages through which the cleaning agent can flush past the clogged place and thereby dissolve the clogging when the flushing is carried out for a sufficiently long time.

The invention is described in the following with reference to the accompanying drawings. The plate heat exchanger proper is illustrated by way of one embodiment while five different embodiments of the plates are shown.

DETAILED DESCRIPTION

Figure 1:
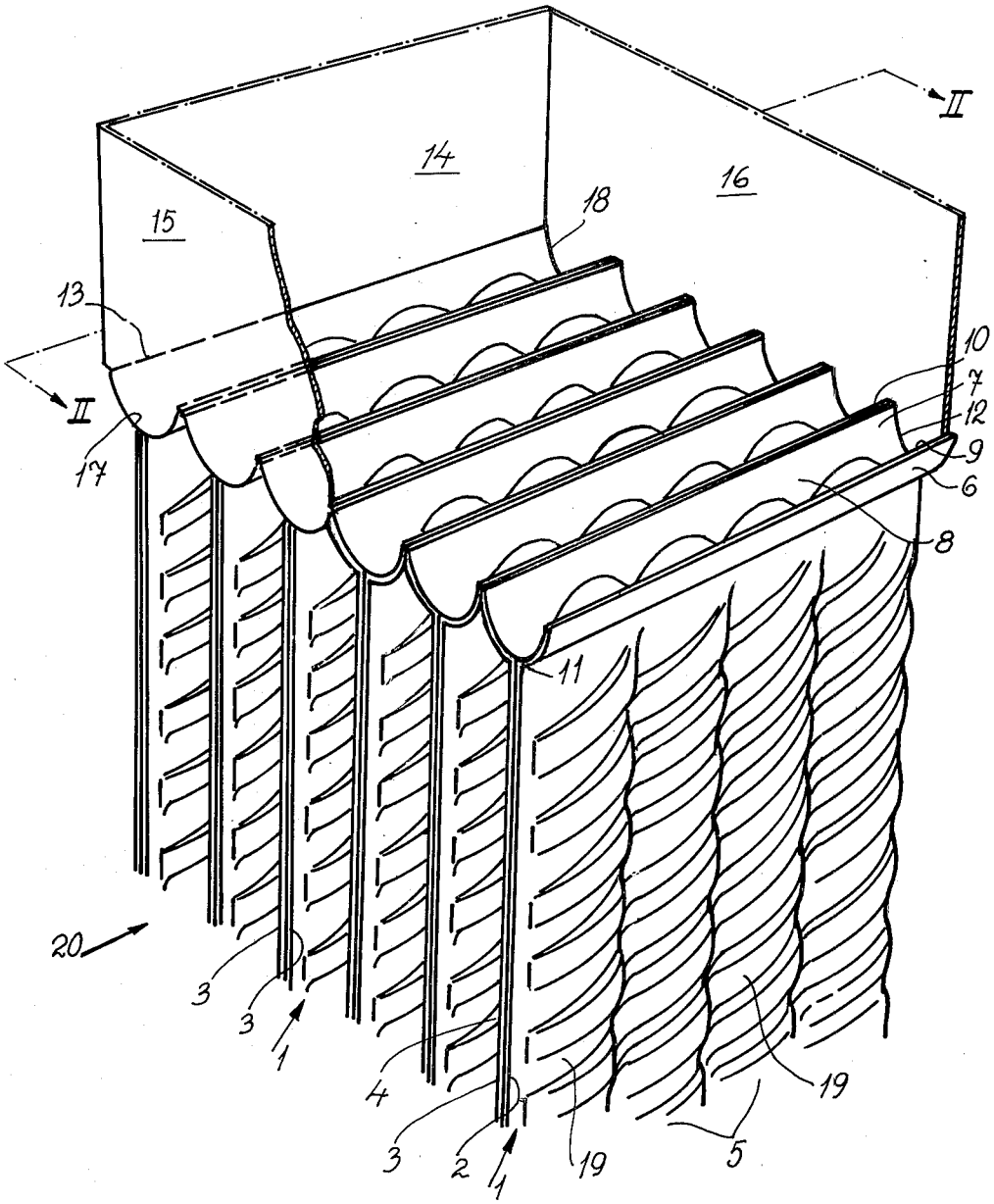
FIG. 1 is a perspective view, partially in section, of a plate heat exchanger without enclosing casing, and of only the upper parts of the plates with associated connecting piece for connection to a distribution box or collection box.

The plate heat exchanger according to FIG. 1 comprises six upright plates 1. Each plate is assembled of two sheets 2 and 3, which are placed against each other and welded one to the other along the longitudinal edges 4. Each sheet is formed with a number of valleys 5. At the mounting, the valleys in one sheet are positioned directly in front of the valleys in the second sheet, so that the valleys connected in pairs form passages. In FIG. 1 four valleys for every sheet 2 and 3 are shown. The sheets are flattened at the ends in the edge areas 6 and 7, respectively, and the edge areas are folded outward along an arc-shaped line such a distance downward on the sheets, that the passages are upwardly open in FIG. 1, in spite of the flattening of the sheets. Owing to the flattening and outward folding, in arc-shaped, each plate is provided at the end edge with a semi-arc shaped valley 8 with straight edges 9 and 10. The ends of the valleys 8 have semicircle-shape along the edges 11 and 12. When the plates are assembled to a plate package, the plates are jointed preferably by fusion welding along the edges 9 and 10. The two outermost edges in the plate package—in FIG. 1 the edge 9—and an edge 13 can be jointed simply by welding with a side, for example 14 or a connecting piece. For connecting the two remaining sides to the connecting piece, the edges of the sides must be formed so, that they agree with the semicircle-shaped edges 11 of the plates. It appears from FIG. 1 that the sides 15 and 16 have been given wave-shape at the lower edge 17 and 18, respectively. The edges 11 and 17, thus, agree as to their shape, and welding along these two abutting edges can be carried out. The jointing will be described further in the following with reference to FIGS. 2 and 4.

The valleys 5, as appears from FIG. 1, form unobstructed passages in the longitudinal direction of the sheets, i.e. in parallel with the welded edges of the plates. The passage walls have an arc-shape and are reinforced by the grooves 19 impressed therein perpendicularly to the longitudinal extension of the valleys 5. The grooves extend from one longitudinal edge of the sheet transversely across the valleys to the other longitudinal edge of the sheet, but terminate in gradual flattening to the sheet plane for preventing the sheet from being wave-shaped along this edge. It is to be observed that the grooves are impressed both in the bottom of the valleys and in the top points, and at least to a depth corresponding to the sheet thickness. This implies that the sheets on the inside have elevated points in the places where the grooves intersect the transition from a valley to an adjacent one. These elevations form contact points for the sheets lying directly in front of each other. Between the support points, thus, openings are formed which provide flow connection between passages extending in parallel and to the side of each other.

In the embodiment shown in FIG. 1 a casing enclosing the plate package is omitted. It is understood, that one of the two heat exchanging media flows through the plates, for example downward from above according to FIG. 1 and through the passages formed by the valleys 5. The passages have a straight extension, but it is understood that the cross-section of the passages constantly varies due to the groove arrangement. The flow rate, therefore, changes constantly, and the medium meets projecting edges and protrusions, which also contributes to rate changes and turbulence formations. The heat transfer between the inside of the sheet and the medium is thereby improved.

The second one of the two media flows between the plates and, for example, from the left to the right according to the direction of arrow 20. The flow of the medium is determined by the casing (not shown), its shape and its outlet and inlet, respectively. As appears from FIG. 1, the outer surfaces of the plates are also irregular, which favours the heat exchange with the plate surface advantageously. As an example thereof, when a condensation film would develop on the outer surfaces of the plates, the liquid film will follow the inclined grooves and then be released from the plate side in droplets. This implies that a plate surface never completely can be covered by a condensate film. The formation of a condensate film deteriorates the heat transfer between the flowing medium and the plate sheets.

It may further be pointed out that the sheets can be manufactured by pressing in only one operational step. The valleys can be given different cross-sectional shapes, as appears from FIGS. 5–14, as will be described in the following. The grooves are impressed with a certain inclination relative to the longitudinal axis of the valleys. Grooves extending fully perpendicularly to the longitudinal axis yield a poorer effect than grooves having a certain angle of inclination relative to said axes. Although the grooves are impressed into the sheets, it was found that a very thin material can be used without risk of fracture. The grooves reinforce the sheets or increase their capacity of receiving unidirectional pressure loads. The grooves, thus, are of importance with respect to the manufacture of the plates proper as well as to the strength of the plates and, in addition, the grooves have a favourable effect on the flow pattern for the media.

Figure 2:
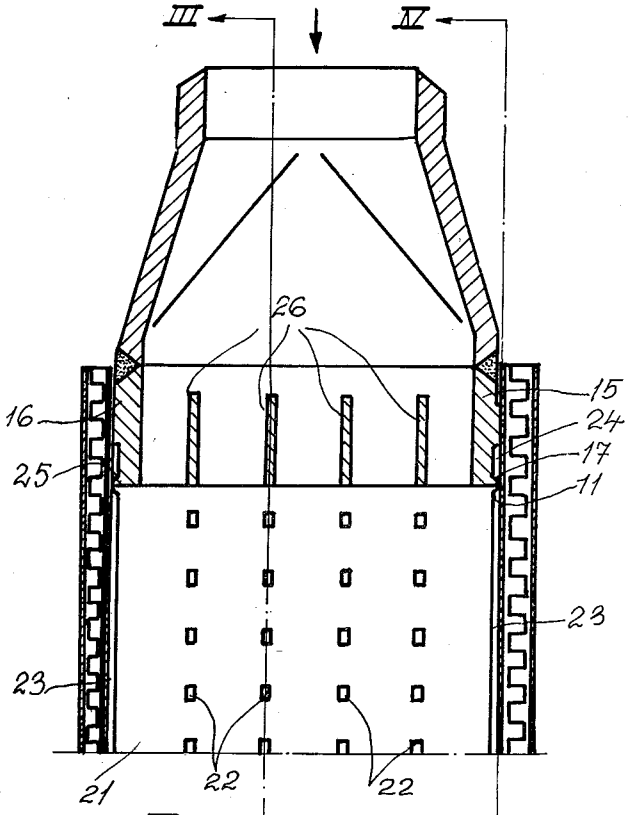
FIG. 2 is a section on a smaller scale in the longitudinal direction of the plates through the upper part of a plate heat exchanger according to FIG. 1.

FIG. 2 is partially a section along the line II—II and on a smaller scale of FIG. 1. The numeral 21 designates a passage in a plate. The cross-section, it is understood, comprises five passages 21 instead of the four passages shown in FIG. 1. The numeral 22 designates the supporting points, which were mentioned earlier, and which are located between each sheet in the plates. The connecting piece or distribution box has the side walls 15 and 16 as in FIG. 1. Said walls, as can be seen, have a greater material thickness than the sheets. Longitudinal joint edges between the sheets in the plates are designated by 23.

In the same way as described with reference to FIG. 1, the lower edge 17 of the side 15 has wave-shape for connection to the wave-shaped edges 11 of the plates. This is apparent also from FIG. 4, which is a section along the line IV—IV in FIG. 2. In order to facilitate the welding between the edge 17 and the edge 11, an annular area 24 is milled out in the side 15 near the edge 17 whereby a laterally projecting flange edge 25 is formed, see the left-hand portion of FIG. 2 and the left-hand portion of FIG. 4. The reference numerals refer to these parts of the figures only for clarity. Said flange edge 25, which has the same wave-shape as the edge 17, and thus as the edge 11, provides a good fusion welding possibility between the two wave-shaped edges of the sides 15 and the plates. In this connection may be mentioned, that the edges 11 and 17 have been given wave-shape, but that, of course, another shape, for example a rectilinear one, can be used. The edge line 17 in such a case will be given a tooth-shaped appearance, and the edge line 11 a corresponding tooth-shaped one. To the sides 15 and 16 and opposed sides then a pipe connecting piece, a distribution box or the like can be connected.

Figure 3:
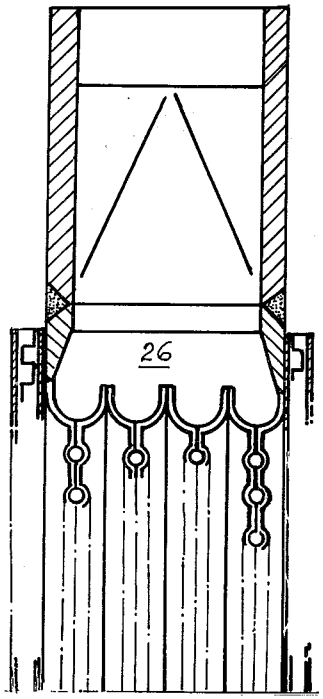
FIG. 3 is a section along the line III—III in FIG. 2.

FIG. 3 is a section along the line III—III in FIG. 2 and shows that support sheets 26 are inserted in parallel with the sides 15 and 16 within the connecting piece, in order to withstand high pressure. From FIG. 3 appears the shape of these support sheets which agrees with what has been described above concerning the attaching or jointing between the edges 17 and 11.

In the above descriptive part the reference numerals 15 and 16 have designated sides in a connecting piece. The sides 15 and 16 may also be regarded as strips, and the same applies to the sides opposed thereto, and assembled and mounted they may be regarded as constituting a transmission piece from the plate package to a distribution box. It is known from experience that just this area is one of the most difficult ones from a welding point of view and that it also is the area exposed to the most substantial stresses purely mechanically.

Figure 4:
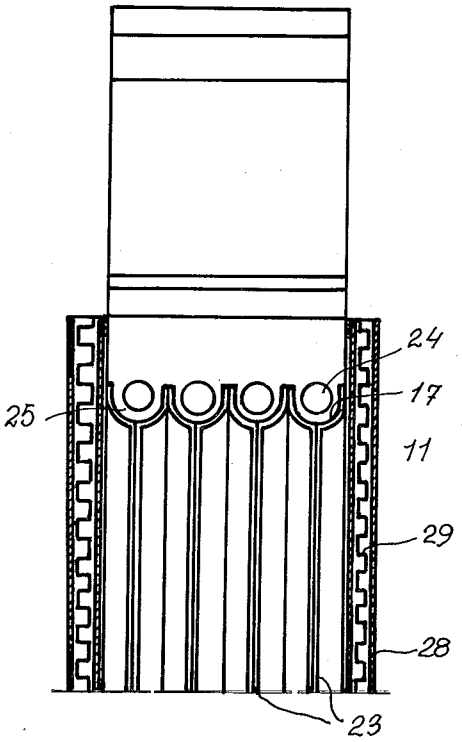
FIG. 4 is a section along the line IV—IV in FIG. 2.

From FIGS. 2–4 also a suitable structure of the casing enclosing the plate package is apparent. The casing, as can be seen, can be assembled of a first plane metal sheet 27 and a second plane metal sheet 28, between which a corrugated metal sheet 29 is located. Said corrugated sheet 29 preferably is designed so that wave crests and wave troughs are formed right-angled, as also is apparent from the figures. The three sheets may be spot-welded in such a manner, that some kind of honeycomb structure is obtained. In this way four sides of a casing are formed, and the jointing of the casing can be carried out in any suitable way. The casing is held together against inside pressure either only by its own rigidity, or frame structures of beam material may enclose the casing, which also can be effected in a manner known per se. A suitable structure in this respect is to be chosen in view of the inside pressure the casing is intended to withstand.

Figure 5:
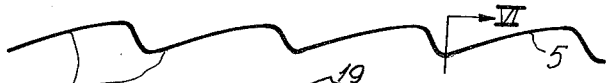
FIG. 5 shows the cross-sectional shape of a sheet.
Figure 6:
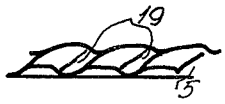
FIG. 6 is a cross-section through FIG. 5 according to the line VI.
Figure 7:
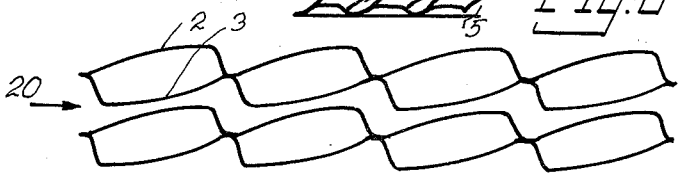
FIG. 7 shows two plates, each assembled with the sheets according to the shape in FIG. 5.

In FIGS. 5–14 different shapes of sheets and of plates assembled thereof are shown. FIG. 5 shows the cross-sectional shape of a sheet disclosing the valleys 5. It is to be observed that the grooves do not appear here. From FIG. 5 is apparent that the cross-section of the valleys in principle have been given the shape of half a pear. In FIG. 6 a cross-section along the line VI in FIG. 5 is seen, and from this section both the valley 5 in its longitudinal extension and the grooves 19 are apparent. FIG. 7 shows two plates assembled of the sheets having valleys of the shape shown in FIG. 5. It is to be observed that the sheets 2 and 3 here are turned so that the passage shape is asymmetric. It appears from FIG. 7, that the plate shape at such two adjacent plates falls one into the other, and that a meandering path between two adjacent plates in the direction of arrow 20 is obtained. See also FIG. 1.

Figure 8:
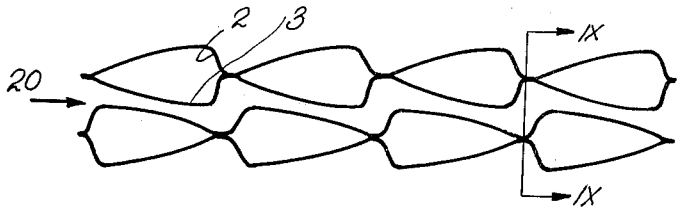
FIG. 8 shows two plates assembled by the sheet shape according to FIG. 5, but in reversed shape.
Figure 9:
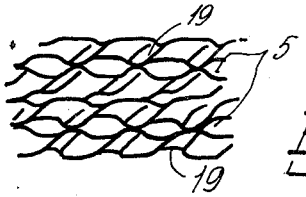
FIG. 9 is a section along the line IX—IX in FIG. 8.

FIG. 8 shows two plates assembled of sheets having the shape as shown in FIG. 5, where the sheets 2 and 3, however, have been turned so that a cross-sectional shape resembling an entire pear is obtained. Also in this case a meandering path between two adjacent plates in the direction of arrow 20 is obtained. FIG. 9 is a cross-section according to line IV—IV in FIG. 8 from which the grooves 19 and the passages 5 are apparent.

Figure 10:
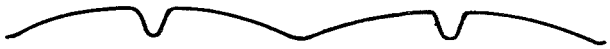
FIG. 10 shows a different shape of sheets.
Figure 11:
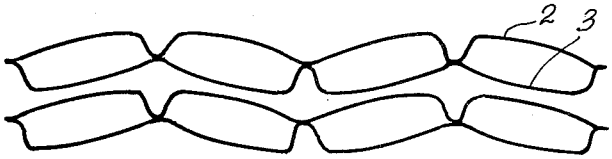
FIG. 11 shows two plates lying adjacent one another assembled of the sheets according to the shape in FIG. 10.
Figure 12:
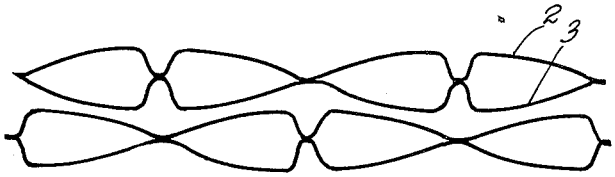
FIG. 12 shows a modification of plates assembled with the sheets according to FIG. 10.

FIG. 10 shows another cross-sectional shape of a sheet. FIG. 11 shows two plates one adjacent the other and assembled of two sheets according to FIG. 10. FIG. 12 shows an alternative assemblage of the sheet shape shown in FIG. 10 and two plates adjacent each other.

Figure 13:
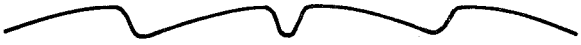
FIG. 13 shows a further modified embodiment of a sheet for the plates.
Figure 14:
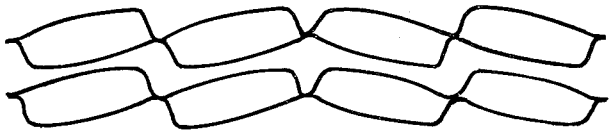
FIG. 14 shows two plates assembled of sheets according to the shape in FIG. 13.

FIG. 13 shows still another embodiment of a sheet, and FIG. 14 shows two plates adjacent each other and assembled of two sheets having the shape as shown in FIG. 13.

Although according to the aforesaid the valleys at a particularly suitable embodiment have been given asymmetric cross-sectional shape relative to their symmetry line, it is to be understood that the cross-sectional shape can be entirely symmetric and, for example, have the shape of a portion of an arc. The cross-sectional shape of the grooves 19 appears, for example, from FIGS. 6 and 9, but this shape can be varied within the scope of the invention idea and may be more or less meandering at the bottom or pointed. The inclination angle to the longitudinal extension of the valleys can be varied within the scope of the invention idea and can be said to be, for example, between 15° and 45°.

I claim:

1. A plate heat exchanger comprising a plurality of plates arranged in substantially parallel spaced relationship, each plate consisting of two sheets facing toward each other and welded along two parallel edges, said sheets being formed with longitudinal valleys, which facing toward each other form passages between the sheets when the sheets abut each other, said valleys being formed with impressed grooves extending transversely to the longitudinal direction of the valley and continuously from one outermost located valley to the outer outermost located valley, said grooves extending at a certain acute angle to the longitudinal direction of the valleys, said cross-sectional shape of the valleys being asymmetric relative to the longitudinal center line of the valley.

2. A plate heat exchanger as defined in claim 1 wherein the impression depth of the grooves corresponds at least to the thickness of the sheets.

3. A plate heat exchanger as defined in claim 1 wherein the grooves at the intersections with the defining lines between the valleys form a number of equally high located points, which form support surfaces for sheets laid against each other.

4. A plate heat exchanger as defined in claim 1, wherein the ends of the sheets where the valleys terminate are flattened and folded outward to the side where the valleys bulge, and such a distance that it corresponds at least to the height of the bulging, whereby the free edge can be placed against a likewise free edge of an adjacent sheet and welded together along the edges.

5. A plate heat exchanger as defined in claim 4, wherein the outward folding has arc-shape, so that the longitudinal edges of two sheets forming a plate terminate at the passage ends of the plate in a semicircle-shaped edge.

6. A plate heat exchanger as defined in claim 5, wherein the semicircle-shaped edges form joint edges for the walls of a distribution connecting piece to the plates.

7. A plate heat exchanger as defined in claim 1, wherein the casing about the plates consists of two spaced metal sheet layers, between which a corrugated metal sheet is laid which preferably has wave crests and troughs of rectangular cross-section.

8. A plate heat exchanger wherein a plurality of plates are arranged in substantially parallel spaced array, each plate comprising two sheets facing toward each other and formed with longitudinal valleys, which facing toward each other form passages between the sheets when the sheets abut each other, said valleys having a cross-sectional shape corresponding to the shape of half a pear and being assymetric relative to the center line of the valley, and impressed grooves formed in said valleys extending transversely to the longitudinal direction of the valleys and continuously from one outermost located valley to the other outermost located valley.

9. A plate heat exchanger wherein a plurality of plates are arranged in substantially parallel spaced array, each plate comprising two sheets having longitudinal valleys formed thereon which when said sheets are placed together in facing relationship form passages between the sheets, impressed grooves formed in said valleys extending transversely to the longitudinal direction of the valleys and continuously from one outermost valley to the other outermost valley, the ends of said sheets where the valleys terminate being flattened and folded into an arc shaped portion extending outward to the side where the valleys bulge for a distance that corresponds at least to the height of said bulge, the free edges of each sheet of each plate being welded together so that said arc shaped portions form a semicircular shaped edge, strips welded to said plates at said semicircular shaped edge to form a transition to the walls of a distribution connecting piece, said strips having a greater thickness than the plate edges.

10. A plate heat exchanger as defined in claim 9, wherein said strips have a contoured edge which corresponds to the semicircular edges of the plates and located adjacent the same where they are welded together.

* * * * *